US007439469B2

(12) United States Patent
Gerving

(10) Patent No.: US 7,439,469 B2
(45) Date of Patent: Oct. 21, 2008

(54) ELECTRIC SWITCHING DEVICE COMPRISING AN ARC-QUENCHING UNIT

(75) Inventor: Karsten Gerving, Bonn (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 10/575,922

(22) PCT Filed: Sep. 27, 2004

(86) PCT No.: PCT/EP2004/052324

§ 371 (c)(1),
(2), (4) Date: Apr. 14, 2006

(87) PCT Pub. No.: WO2005/036577

PCT Pub. Date: Apr. 21, 2005

(65) Prior Publication Data

US 2007/0045235 A1 Mar. 1, 2007

(30) Foreign Application Priority Data

Oct. 18, 2003 (DE) ..... 203 16 027 U

(51) Int. Cl.
*H01H 33/02* (2006.01)

(52) U.S. Cl. ..... 218/38; 218/34; 218/149; 218/156

(58) Field of Classification Search ..... 218/15, 218/12, 34, 35, 38, 147, 149, 156, 157; 335/201, 335/202
See application file for complete search history.

(56) References Cited

U.S. PATENT DOCUMENTS 5,589,672 A * 12/1996 Uchida et al. ..... 218/34
6,191,377 B1 2/2001 Roesner et al. ..... 218/149
6,207,916 B1 3/2001 Pniok et al. ..... 218/1
6,703,575 B1 * 3/2004 Yamamoto ..... 218/46
6,844,514 B2 1/2005 Bach et al. ..... 218/149

FOREIGN PATENT DOCUMENTS

| | | |
|---|---|---|
| DE | 41 09 717 C1 | 9/1992 |
| DE | 197 15 116 | 10/1998 |
| DE | 198 14 411 C1 | 7/1999 |
| DE | 100 36 370 | 1/2002 |
| EP | 1 302 957 | 4/2003 |

OTHER PUBLICATIONS

Franken, "Niederspannungs-Leistungsschalter [Low-Voltage Circuit-Breakers]"; Berlin, Heidelberg, New York 1979, pp. 59-62); [Discussed in specification].
International Search Report for PCT/EP2004/052324 (2 pages).

* cited by examiner

*Primary Examiner*—Elvin Enad
*Assistant Examiner*—Marina Fishman
(74) *Attorney, Agent, or Firm*—Darby & Darby

(57) ABSTRACT

An electric switching device, designed to carry a low-voltage, in particular a circuit-breaker or contactor, having at least one arc-quenching unit (16;18) is provided. Connection contacts (8) are mounted in a housing (2) that can be sealed by a cover (4) and switching chambers (10) are configured in the housing. To adapt the device to different current ranges, the housing (2) and cover (4) are equipped with guide and retaining elements (12, 26, 28, 30) for cooling plates (16) that can be inserted and for arc-quenching laminated cores (18) that can be interchanged with the plates.

4 Claims, 3 Drawing Sheets

ELECTRIC SWITCHING DEVICE COMPRISING AN ARC-QUENCHING UNIT

The present invention relates to an electrical switching device designed for low voltage, in particular a circuit-breaker or contactor, having at least one arc-quenching device, having externally accessible terminal contacts being secured in position in a housing which can be closed by a cover and in which interrupting chambers are formed; and each interrupting chamber having disposed therein a stationary switching contact, a movable switching contact cooperating with said stationary switching contact, as well as at least one arc-quenching device.

BACKGROUND

When switching devices interrupt high currents, in particular short-circuit currents, electric arcs form in the interrupting chambers thereof. In "Niederspannungs-Leistungsschalter [Low-Voltage Circuit-Breakers]"; Berlin, Heidelberg, New York 1979, pages 59 through 62, Franken describes the following methods for quenching electric arcs: extending the length of the arc, cooling the arc, and dividing the arc. In the arc-cooling method, the intensive cooling of the arc is essentially accomplished by contact with insulating parts or cooling plates. In the arc-division method, the electric arc is driven by magnetic forces into a system of arc splitter plates disposed in a parallel or curved arrangement, the arc being divided into several partial arcs, which results in a considerable increase in the voltage losses within the entire arc. In comparison with arc splitter plates, cooling plates are simpler and, therefore, less expensive to manufacture, but inferior in terms of the magnitude of the arc current to be extinguished.

DE 41 09 717 C1 discloses a contactor including an electromagnetic operating mechanism which is arranged in a multi-part housing, switching contacts which are accommodated in an interrupting chamber, and further including arc splitter plates which are associated with the switching contacts and form extinguishing chambers, and which are accommodated in a top housing part which can be closed by a cover. The arc splitter plates, which are assembled by means of insulating plates to form arc splitter plate stacks and are inserted into the housing chambers, are resiliently pressed and clamped against the wall of the top housing part by means of end legs of commutation plates, said end legs being bent in a double U-shape.

In a contactor according to DE 198 14 411 C1, the uppermost arc splitter plate, which faces the cover and is designed as a shield plate, has two clips which are bent upward. Recesses corresponding to the clips are formed on the inner side of the cover. The extinguishing chambers can be fastened to the cover by inserting the clips in the recesses, forming a positive-locking joint.

SUMMARY OF THE INVENTION

It is an object of the present invention to make switching devices suitable for switching operation in different current ranges in a simple manner.

The housing and the cover are provided with guide and retaining elements for both cooling plates and arc splitter plate stacks. Thus, switching devices which are otherwise identical in design can optionally be equipped with arc-quenching devices in the form of cooling plates or in the form of arc splitter plate stacks. When equipped with cooling plates, a less expensive switching device variant is obtained, whereas the variant equipped with arc splitter plate stacks provides a switching device having a higher switching capacity. Thus, the particular desired switching device variant can be produced with little effort while retaining the other component parts.

In an advantageous embodiment of the present invention, the arc splitter plates are guidingly secured in place by inner walls and formations of the housing and by first retaining elements of the cover which provide a hold-down effect. In another embodiment, the arc splitter plate stacks are secured in place by second retaining elements of the cover. In an advantageous embodiment, the guide and retaining elements for the cooling plates and those for the arc splitter plate stacks are arranged one behind the other; the guide and retaining elements for the cooling plates being closer to the switching contacts, while the guide and retaining elements for the arc splitter plate stacks are closer to the terminal contacts.

BRIEF DESCRIPTION OF THE DRAWINGS

Further details and advantages of the present invention will become apparent from the exemplary embodiment described below with reference to the Figures, in which.

DETAILED DESCRIPTION OF AN EMBODIMENT

Figure 1:
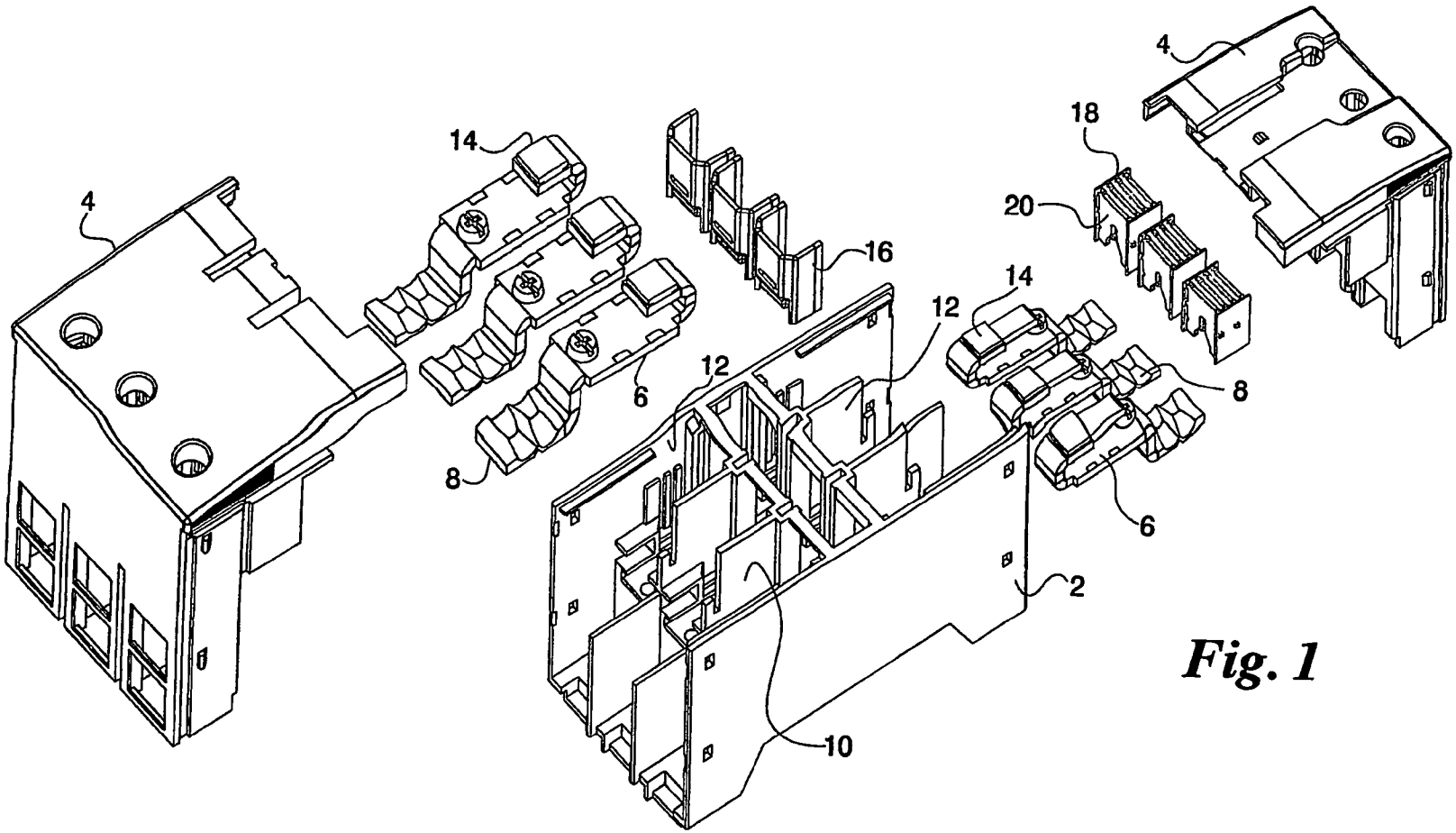
FIG. 1 is a perspective exploded view of the switching device of the present invention, including arc-quenching devices.

FIG. 1 shows the top part of a multi-part housing 2 and a two-part cover 4, which closes the housing 2, of an electrical switching device, such as a three-pole contactor. For each pole, two contact straps 6 are secured in position in housing 2, said contact straps having externally accessible terminal contacts 8. Contact straps 6 extend into interrupting chambers 10, which are laterally bounded by inner walls 12 formed in housing 2. On the interrupting chamber side, contact straps 6 are provided with stationary switching contacts 14, which cooperate in a known manner with movable switching contacts (shown schematically as 29 in FIG. 5) in the form of contact bridges. An arc-quenching device, either in the form of a U-shaped cooling plate 16 or in the form of an arc splitter plate stack 18 of spaced-apart stacked arc splitter plates 20, can be inserted into each interrupting chamber 10. To this end, guide and retaining elements are formed in housing 2 and in cover 4, said guide and retaining elements being described in more detail below. In each interrupting chamber 10, the mounting position of cooling plate 16 and the mounting position of arc splitter plate stack 18 extend one behind the other with respect to the longitudinal direction of the respective switch pole. In this connection, the mounting position of cooling plates 16 is closer to stationary switching contacts 14, while the mounting position of the arc splitter plate stacks 18 is closer to terminal contacts 8.

Figure 3:
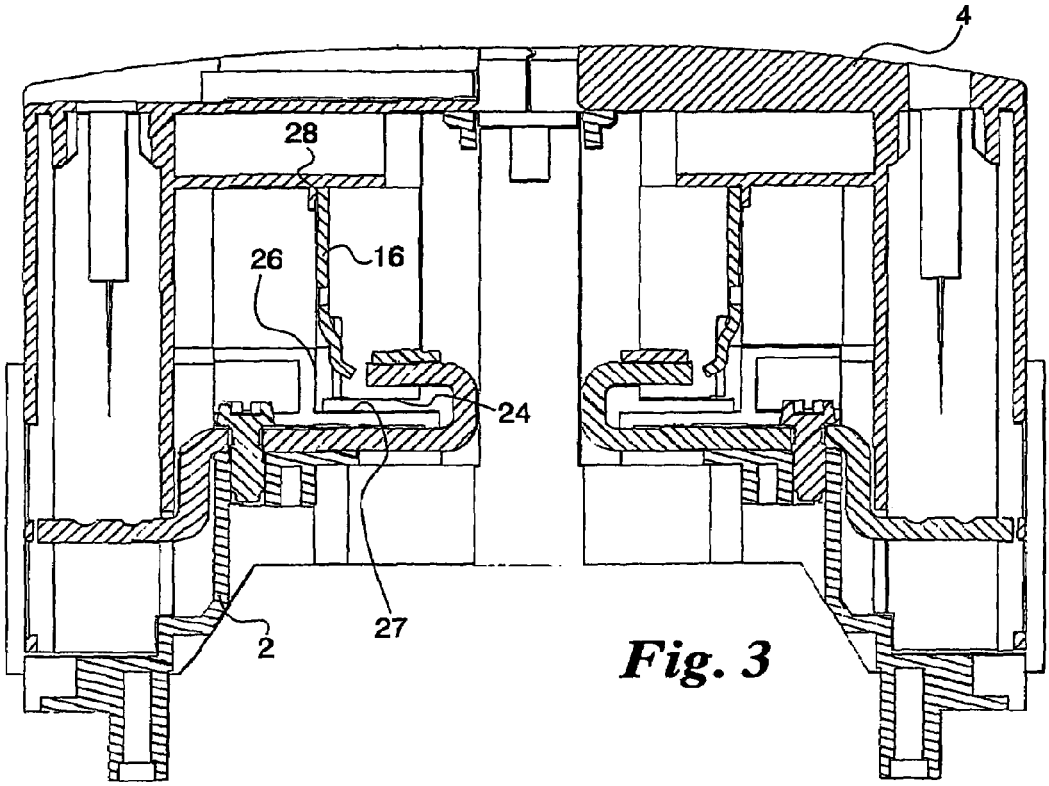
FIG. 3 shows longitudinal section III-III according to FIG. 2, with the cover mounted.
Figure 2:
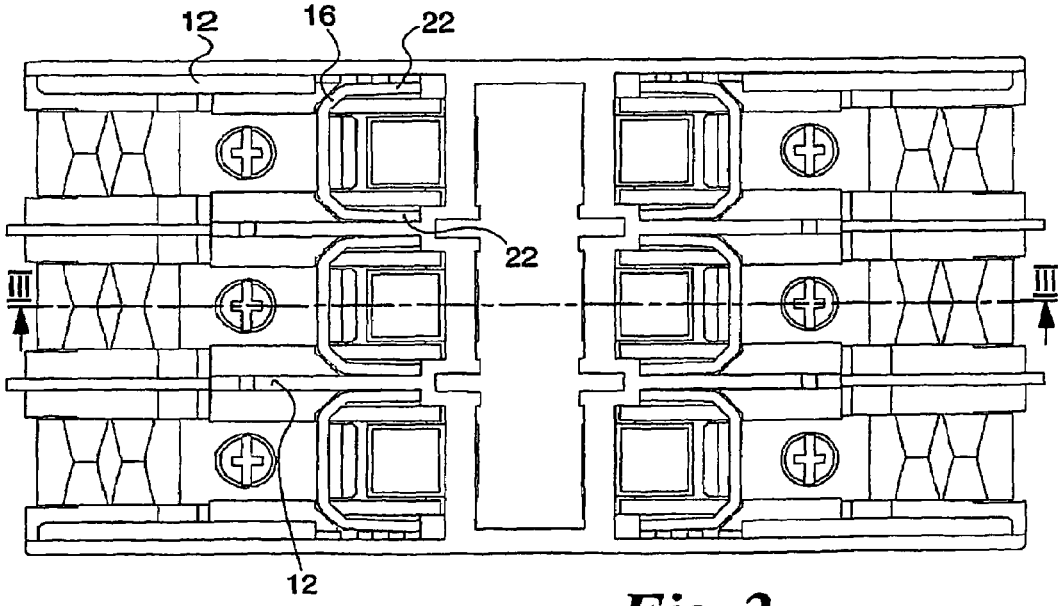
FIG. 2 is a top view of the open housing with the cooling plates inserted.

According to FIG. 2 and FIG. 3, cooling plates 16 are laterally guided, with their outer legs 22, by inner walls 12 and, with their end faces 24 that face away from cover 4, they are positioned in their proper locations in pocket-like formations 26 in bottom 27 of the shown housing part of housing 2.

Formed on the inner side of cover 4 are first retaining elements 28, which hold down and lock cooling plates 16 in their mounting position, when cover 4 is mounted.

Figure 5:
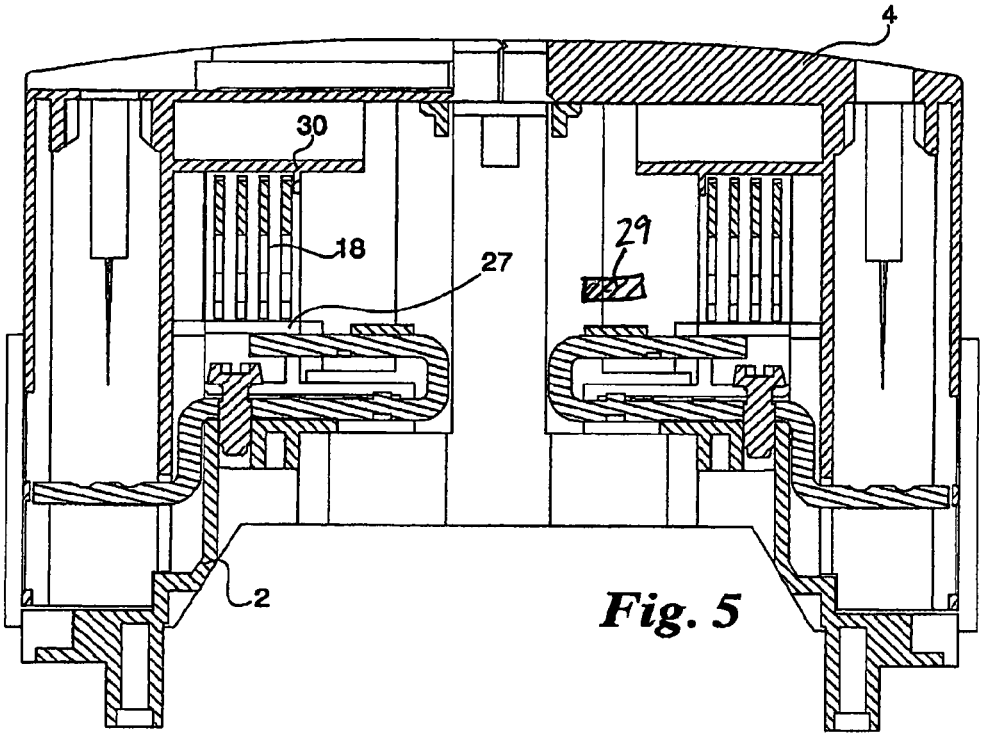
FIG. 5 shows longitudinal section V-V according to FIG. 4, with the cover mounted.
Figure 4:
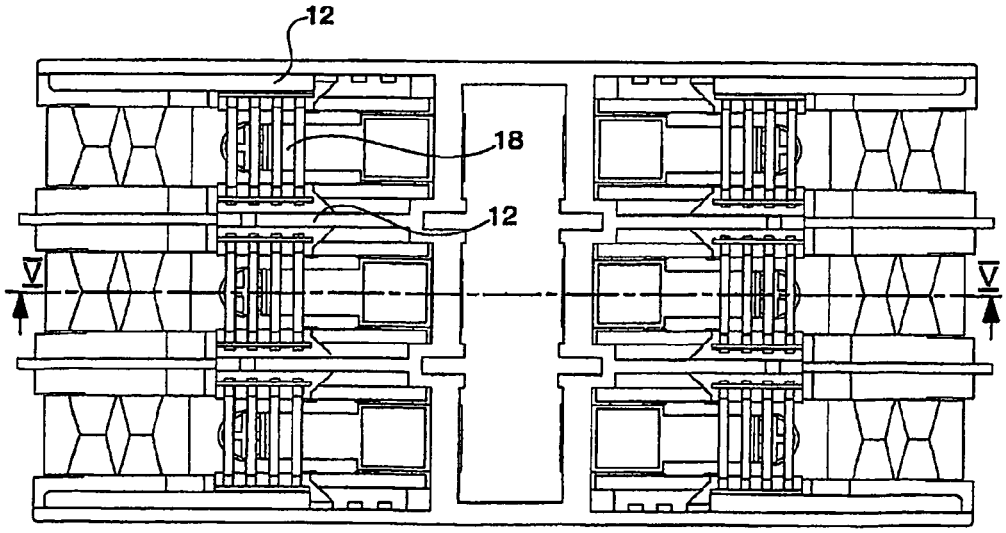
FIG. 4 is a top view of the open housing with the arc splitter plate stacks inserted.

According to FIG. 4 and FIG. 5, arc splitter plate stacks 18 can be secured with one side in pocket-like second retaining elements 30 of cover 4, forming a frictional and/or form-locking connection. After placing cover 4 onto housing 2, arc splitter plate stacks 18 are locked in their mounting position between inner walls 12 as well as between bottom 27 of housing 2 and cover 4.

What is claimed is:

1. An electrical switching device comprising:

a housing having interrupting chambers;

a cover capable of closing the housing; and externally accessible terminal contacts being secured in position in the housing; each interrupting chamber having disposed therein an arc quenching device and a stationary switching contact for a cooperating movable switching contact, the housing and the cover having formed therein guide and retaining elements configured to retain the arc quenching device, wherein the arc quenching device is, alternatively, one of an arc splitter stack and a cooling plate, the arc splitter stack being interchangeable with the cooling plate wherein the guide and retaining elements include inner walls of the housing laterally bounding the interrupting chambers, first retaining elements of the cover, and pocket-like formations in the bottom of the housing, the inner walls being configured to support outer legs of the arc quenching device and the first retaining elements configured to further hold down the arc quenching device.

2. The electrical switching device as recited in claim 1 wherein the guide and retaining elements includes arc splitter guide and retaining elements and cooling plate guide and retaining elements, the arc splitter guide and retaining elements being adjacent to the guide and cooling plate retaining elements in a direction of the terminal contacts.

3. An electrical switching device comprising:

a housing having interrupting chambers;

a cover capable of closing the housing;

externally accessible terminal contacts being secured in position in the housing;

a stationary switching contact located in each interrupting chamber, the stationary switching contact cooperating with a movable switching contact;

an arc quenching device located in each interrupting chamber, the arc quenching device being either an insertable cooling plate or an arc splitter stack, the arc splitter stack being interchangeable with the cooling plate, wherein the housing and cover include:

cooling plate guide and retaining elements comprising inner walls of the housing laterally bounding the interrupting chambers, first retaining elements of the cover and pocket-like formations in the bottom of the housing; and arc splitter stack guide and retaining elements comprising inner walls of the housing laterally bounding the interrupting chamber and pocket-like second retaining elements of the cover.

4. An electrical switching device comprising:

a housing having interrupting chambers;

a cover capable of closing the housing; and externally accessible terminal contacts being secured in position in the housing; each interrupting chamber having disposed therein an arc quenching device and a stationary switching contact for a cooperating movable switching contact, the housing and the cover having formed therein guide and retaining elements configured to retain the arc quenching device, wherein the arc quenching device is, alternatively, one of an arc splitter stack and a cooling plate, the arc splitter stack being interchangeable with the cooling plate, wherein the guide and retaining elements include inner walls of the housing laterally bounding the interrupting chambers and pocket-like second retaining elements of the cover, the pocket-like second retaining elements configured to secure the arc quenching device via a frictional and/or form-locking connection, and, when the cover is mounted, the inner walls of the housing being positioned to support the arc quenching device between the inner walls.

* * * * *